US011293356B2

(12) United States Patent
Dai et al.

(10) Patent No.: US 11,293,356 B2
(45) Date of Patent: Apr. 5, 2022

(54) RESET MECHANISM FOR ELECTRONIC THROTTLE BODY

(71) Applicant: Shanghai Auzone Auto Parts Manufacturing Co., Ltd., Shanghai (CN)

(72) Inventors: Yifeng Dai, Shanghai (CN); Xiaofeng Sun, Shanghai (CN); Jian Chen, Shanghai (CN); Jie Xu, Shanghai (CN); Xinxun Ye, Shanghai (CN)

(73) Assignee: Shanghai Auzone Auto Parts Manufacturing Co., Ltd., Shanghai (CN)

( * ) Notice: Subject to any disclaimer, the term of this patent is extended or adjusted under 35 U.S.C. 154(b) by 0 days.

(21) Appl. No.: 17/373,654

(22) Filed: Jul. 12, 2021

(65) Prior Publication Data

US 2021/0340920 A1 Nov. 4, 2021

Related U.S. Application Data

(63) Continuation of application No. PCT/CN2020/071800, filed on Jan. 13, 2020.

(30) Foreign Application Priority Data

Jan. 15, 2019 (CN) ..... 201910034054.2
Jan. 15, 2019 (CN) ..... 201920059319.X

(51) Int. Cl.
*F02D 9/10* (2006.01)
*F02D 11/10* (2006.01)

(52) U.S. Cl.
CPC ..... *F02D 9/1065* (2013.01); *F02D 11/107* (2013.01); *F02D 2011/101* (2013.01)

(58) Field of Classification Search
CPC ..... F02D 9/1065; F02D 11/107; F02D 2011/101; F02D 2009/0269; F02D 11/105
See application file for complete search history.

(56) References Cited

U.S. PATENT DOCUMENTS 5,778,853 A * 7/1998 Saito ..... F02D 11/107 123/361
6,364,287 B1 * 4/2002 Rauch ..... F02D 9/1065 137/315.22
2002/0029760 A1 3/2002 Saito et al.

FOREIGN PATENT DOCUMENTS

CN 106089450 A 11/2016
CN 106471234 A 3/2017
CN 106837563 A 6/2017

* cited by examiner

*Primary Examiner* — Joseph J Dallo
(74) *Attorney, Agent, or Firm* — Mei & Mark LLP; Manni Li

(57) ABSTRACT

A reset mechanism for an electronic throttle body comprising a valve, a throttle shaft, a reset gear, an upper spring seat, a lower spring seat, and a reset spring. A support leg is installed in the reset gear. The upper spring seat, the reset spring, and the lower spring seat are sleeved outside the reset gear. Two ends of the reset spring are fixed to the upper spring seat and the lower spring seat, respectively. The upper spring seat has an upper support leg surface attached to a first side of a valve limiting block and a side of the support leg. The lower spring seat has a lower support leg surface attached to a second side of the valve limiting block and another side of the support leg.

4 Claims, 5 Drawing Sheets

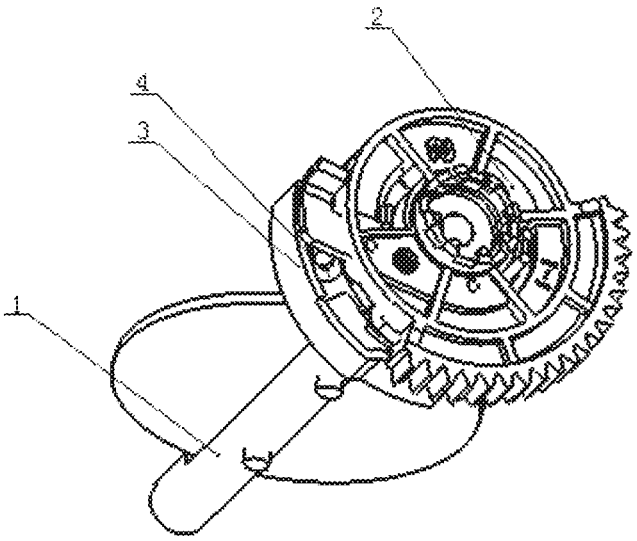
FIG. 1 --Prior Art--
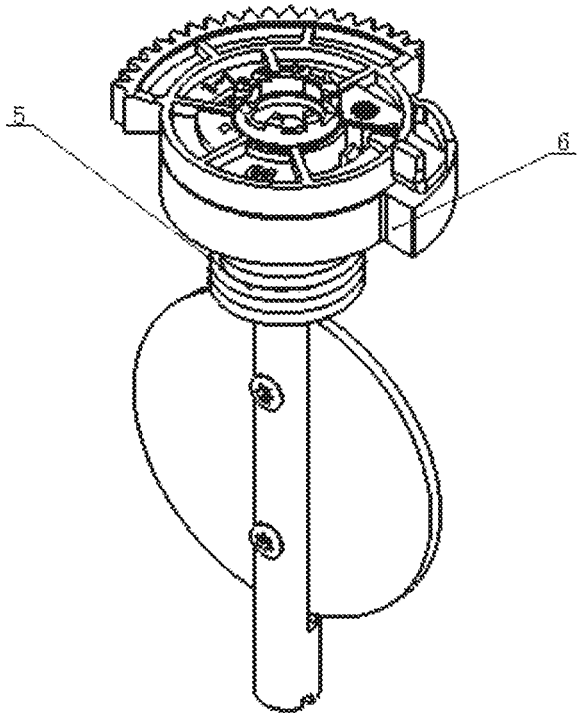
FIG. 2 --Prior Art--

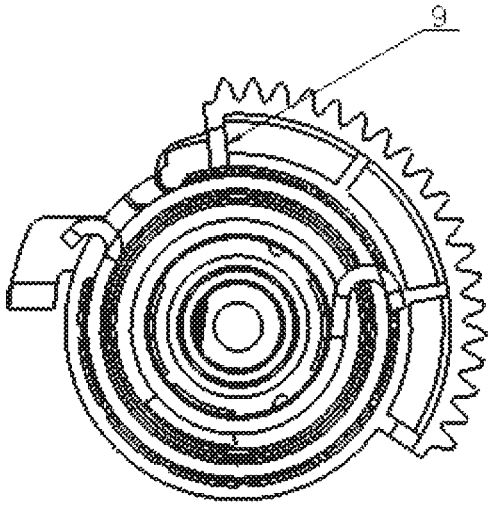
FIG. 3 --Prior Art--
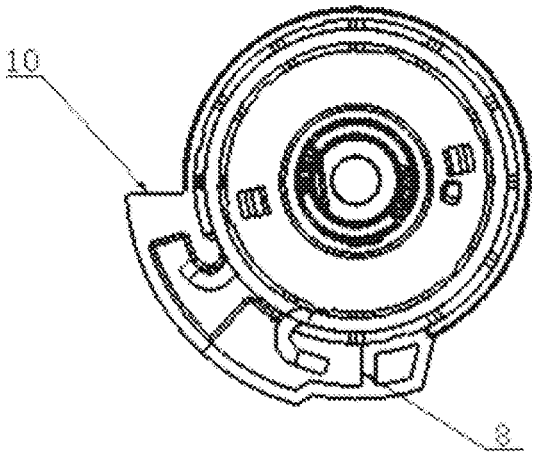
FIG. 4 --Prior Art--

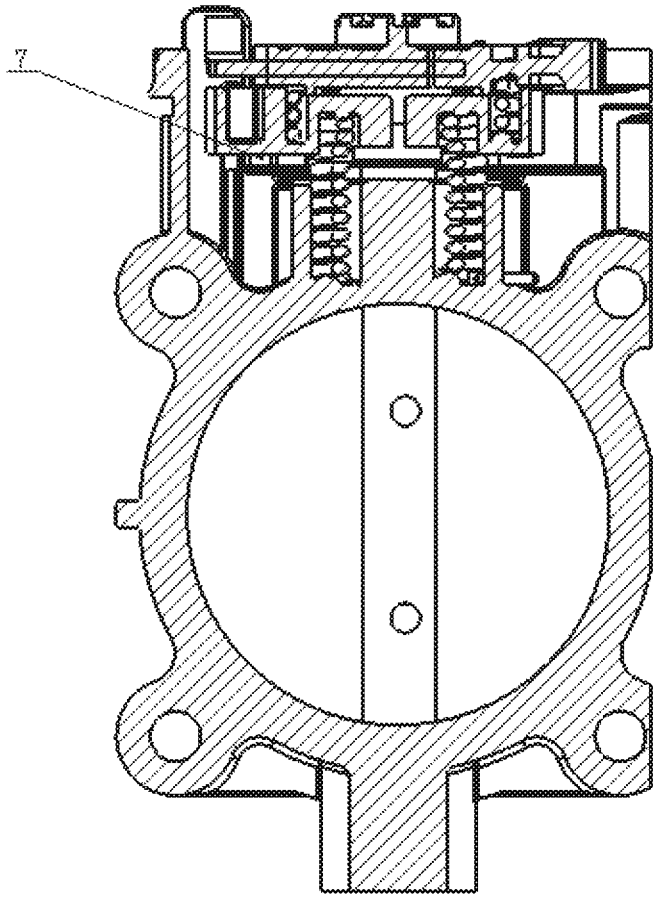
FIG. 5 --Prior Art--

RESET MECHANISM FOR ELECTRONIC THROTTLE BODY

CROSS-REFERENCE TO RELATED APPLICATIONS

The subject application is a continuation of PCT/CN2020/071800 filed on Jan. 13, 2020, which claims priority on Chinese Patent Application Nos. 201910034054.2 and 201920059319.X, both filed on Jan. 15, 2019 in China. The contents and subject matter of the PCT international application and the Chinese priority applications are incorporated herein by reference.

TECHNICAL FIELD

The present invention relates to an electronic throttle body, particularly, a reset mechanism for an electronic throttle body.

BACKGROUND TECHNOLOGY

The electronic throttle body of the vehicle in the current technology has a reset structure as shown in FIGS. 1-5. The reset structure comprises a throttle shaft (1), a reset gear (2), a coupling ring (3), an emergency reset spring (4), and a reset spring (5). One torsion arm of the emergency reset spring (4) is hung in the spring groove of the reset gear (2), and the other is hung in the spring groove of the coupling ring (3). The coupling ring (3) is mounted on the reset gear (2) by two hooks-which extend out. One torsion arm of the reset spring (5) is hung in the spring groove of the coupling ring (3), and the other is hung on the valve. The reverse torque will occur when the emergency reset spring (4) is in the opposite direction of the rotation of the reset spring (5). The purpose of the reset spring (5) is to return the reset gear (2) from any other position to the default position. The limit surface (8) of the coupling ring (3) is in contact with the limit surface (9) of the reset gear (2). From the default position to the full closed position of the throttle body, the emergency reset spring (4) will generate the opposite force to open the reset gear (2). In the default position of the throttle body, the limit surface (10) of the coupling ring is closely attached with the limit surface (7) of the valve. Also, the limit surfaces (8) and (9) are attached to each other under the action of the emergency reset spring.

The design of the reset mechanism solves the problem of reset and makes the throttle body return to the default position. However, it can not guarantee the product consistency. Due to a large number of parts working with each other, there may be many matching errors in the manufacturing process, which leads to different points of the reset mechanism returning to the default position. Moreover, a high number of parts results in an increase in frictional force, which affects the reaction speed of the product.

SUMMARY OF THE INVENTION

The present invention provides a reset mechanism for the electronic throttle body, which solves the problems including matching errors in the manufacturing process, inaccuracy of returning to the default position, slow reaction speed, and so forth (these problems are due to a high number of parts in the reset mechanism for the electronic throttle body). The mechanism of the present invention has simple structure and is produced by simplified manufacturing process and can easily and accurately control the default position of the throttle body.

The reset mechanism for the electronic throttle body of the present invention comprises a valve, a throttle shaft and a reset gear. It is characterized in that it also includes an upper spring seat, a lower spring seat, and a reset spring. The reset gear is provided with a support leg, and the support leg has two sides. The upper spring seat, the reset spring, and the lower spring seat are sleeved outside the reset gear in sequence. One torsion arm of the reset spring is fixed on the upper spring seat and the other torsion arm is fixed on the lower spring seat. The upper spring seat has a support leg surface, which corresponds to one side of the support leg; the lower spring seat has a support leg surface, which corresponds to the other side of the support leg. The throttle shaft is connected to the reset gear after passing through the lower spring seat, the reset spring, and the upper spring seat. There is a limiting block in the valve, and the valve limiting block has the first side and the second side. By default, the support leg surface of the upper spring seat is attached not only to the first side of the valve limiting block, but also to the side of the support leg of the reset gear. The support leg surface of the lower spring seat attached not only to the second side of the valve limiting block, but also to the other side of the support leg of the reset gear.

In the present invention, the reset mechanism for the electronic throttle body is characterized in that the reset gear is composed of a gear part and a rotating part connected under the gear part. A support leg is installed in the axial direction outside the rotating part, and the support leg has 2 sides. The upper spring seat, the reset spring and the lower spring seat are sequentially sleeved outside the rotating part of the reset gear.

In the present invention, the reset mechanism for the electronic throttle body is characterized in that one torsion arm of the reset spring is hung in the groove of the upper spring seat for fixation, and the other torsion arm is hung in the groove of the lower spring seat for fixation.

The technical effect of the present invention is as follows: compared with the previously designed emergency reset mechanism, the present invention can only use a spring to ensure that the throttle plate remains in the mechanism at the emergency point after power failure. The throttle plate can overcome the force of the torsion spring to rotate clockwise and anticlockwise, while the torsion spring ensures that the force will be applied to the reset gear to return to the emergency point position in both directions. The structure eliminates the original coupling ring and the emergency spring, reducing the uncertainty of the mid connection and reducing the frictional force when the coupling ring rotates.

DESCRIPTION OF FIGURES

FIG. 1 shows the structure of a reset mechanism for the electronic throttle body (1).

FIG. 2 shows the structure of a reset mechanism for the electronic throttle body (2).

FIG. 3 shows the structure of a reset gear with a limiting surface in the current technology.

FIG. 4 shows the structure of a coupling ring with a limiting surface in the current technology.

FIG. 5 shows the matching structure of the limiting surface of the coupling ring and the limiting surface of the valve in the current technology.

DETAILED DESCRIPTION OF THE INVENTION

Figure 6:
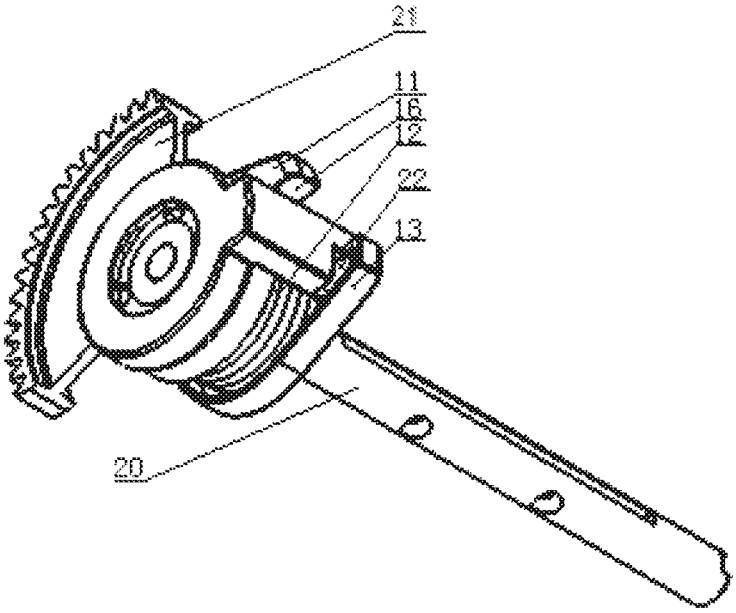
FIG. 6 shows the structure of the reset mechanism for the electronic throttle body (except the valve) in the present invention.
Figure 7:
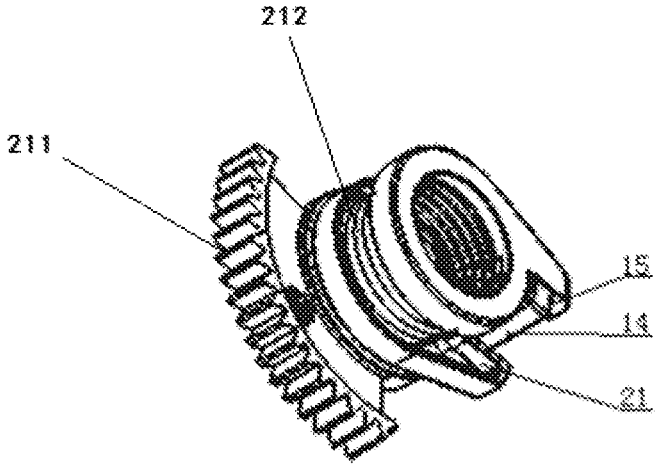
FIG. 7 shows the structure of the reset mechanism for the electronic throttle body with the reset gear, and the upper and lower spring seats in the present invention.
Figure 8:
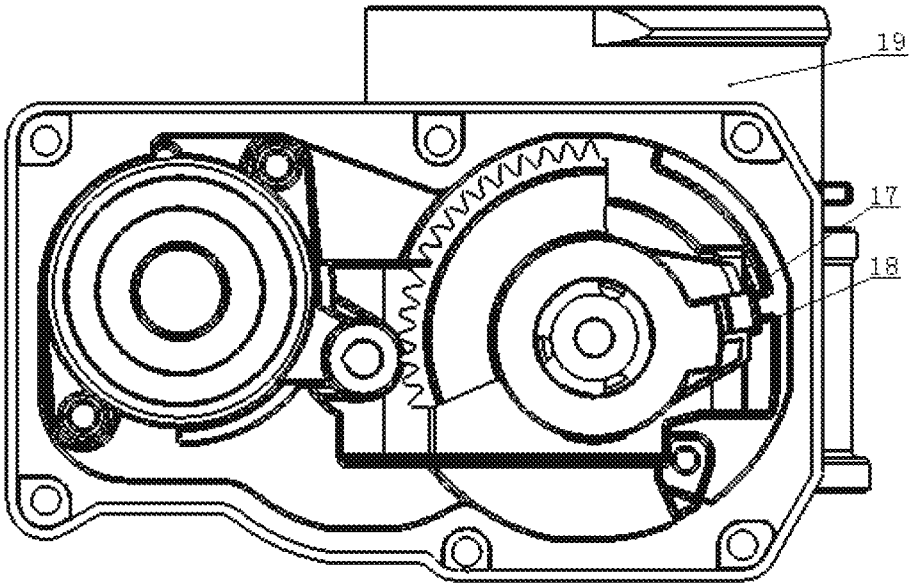
FIG. 8 shows the use structure of the reset mechanism for the electronic throttle body in the present invention.

As shown in FIGS. 6, 7, and 8, the present invention provides a reset mechanism for an electronic throttle body, which comprises a valve (19), a throttle shaft (20), a reset gear (21), an upper spring seat (11), a lower spring seat (13), and a reset spring (12). The reset gear (21) is composed of a gear part (211) and a rotating part (212) connected under the gear part (211). A support leg (14) is installed in the axial direction outside the rotating part (212), and the support leg (14) has two sides. The upper spring seat (11), the reset spring (12), and the lower spring seat (13) are successively sleeved outside the rotating part (212) of the reset gear (21), wherein one torsion arm of the reset spring (12) is fixed on the upper spring seat (11), and the other torsion arm is fixed on the lower spring seat (13). The upper spring seat (11) has a support leg surface (16), the support leg surface (16) corresponds one side of the support leg (14); the lower spring seat (13) has a support leg surface (15), and the support leg surface (15) corresponds to the other side of the support leg (14). The throttle shaft (20) sequentially passes through the lower spring seat (13), the reset spring (12), and the upper spring seat (11); then is connected to the reset gear (21) (the welding method can be used, and during welding, the default opening angle of the valve plate can be obtained by turning the throttle shaft (20)). The valve (19) is installed into the above structure. The valve (19) has a limiting block which has a first side (17) and a second side (18). In the default state, the support leg surface (16) of the upper spring seat is attached to both the first side (17) of the valve limiting block and one side of the support leg (14) in the reset gear (21). The support leg surface (15) of the lower spring seat is attached to both the second side (18) of the valve limiting block and the other side of the support leg (14) in the reset gear (21).

When in use, if the reset gear (21) rotates in the axial closing direction, the support leg surface (16) of the upper spring seat will instantly break away from the support leg (14) of the reset gear (21). At the same time, the support leg surface (15) of the lower spring seat will also instantly break away from the second side (18) of the valve limiting block. After the closing action is completed, it will be reset by the spring restoring force. On the contrary, if the reset gear (21) rotates in the axial opening direction, the support leg surface (15) of the lower spring seat-will instantly break away from the support leg (14) of the reset gear (21). At the same time, the support leg surface (16) of the upper spring seat will also instantly break away from the first side (17) of the valve-limiting block. After the opening action is completed, it will be reset by the spring restoring force.

In the present invention, one torsion arm (12) of the return spring (12) is hung in the groove (21) of the upper spring seat (11), and the other torsion arm is hung in the groove (22) of the lower spring seat (13).

In the present invention, a support leg (14) is installed in the axial direction outside the rotating part (212), and the support leg (14) has two sides. The rotating part (212) can also be provided two support legs in the axial direction, and each leg has an outward side.

In the present invention, the valve (19) is provided with a limiting block, which has a first side (17) and a second side (18). It can also be that each of two valve limiting blocks has an outward side.

The mechanism of the present invention has a simple structure and can be made with a simplified manufacturing process and can easily and accurately control the default position of the throttle body.

The above are only the preferred embodiments of the invention, but the invention is not intended to be limited thereby. That is to say, all equivalent changes and modifications made according to the content of the patent application scope of the invention shall be those which are technical for the invention.

We claim:

1. A reset mechanism for an electronic throttle body, comprising a valve, a throttle shaft, a reset gear, an upper spring seat, a lower spring seat, and a reset spring, wherein the reset gear is provided with a support leg, and the support leg has two sides;

the upper spring seat, the reset spring, and the lower spring seat are successively sleeved outside the reset gear;

one torsion arm of the reset spring is fixed on the upper spring seat, and the other torsion arm is fixed on the lower spring seat;

the upper spring seat has a support leg surface that corresponds to one side of the support leg, and the lower spring seat has a support leg surface that corresponds to the other side of the support leg;

the throttle shaft passes through the lower spring seat, the reset spring and the upper spring seat, then is connected to the reset gear;

the valve has a limiting block which has a first side and a second side;

in a default state, the support leg surface of the upper spring seat is attached both to the first side of the valve limiting block and to one side of the support leg of the reset gear;

the support leg surface of the lower spring seat is attached both to the second side of the valve limit block and to the other side of the support leg of the reset gear.

2. The reset mechanism for an electronic throttle body according to claim 1, wherein the reset gear comprises a gear part, and a rotating part connected below the gear part, wherein the rotating part is provided with a support leg in the axial direction, and the support leg has two sides; and the upper spring seat, the reset spring, and the lower spring seat are successively sleeved outside the rotating part of the reset gear.

3. The reset mechanism for an electronic throttle body according to claim 1, wherein one torsion arm of the reset spring is hung in the groove of the upper spring seat for fixation, and the other torsion arm is hung in the groove of the lower spring seat for fixation.

4. The reset mechanism for an electronic throttle body according to claim 2, wherein one torsion arm of the reset spring is hung in the groove of the upper spring seat for fixation, and the other torsion arm is hung in the groove of the lower spring seat for fixation.

* * * * *